US005884359A

United States Patent [19]

Libhart

[11] Patent Number: 5,884,359

[45] Date of Patent: Mar. 23, 1999

[54] SURFACE CLEANING APPARATUS

[75] Inventor: Anthony C. Libhart, Huntsville, Ala.

[73] Assignee: Schwarz Industries, Inc., Huntsville, Ala.

[21] Appl. No.: 710,160

[22] Filed: Sep. 12, 1996

[51] Int. Cl.[6] ..... E01H 1/08

[52] U.S. Cl. ..... 15/346; 15/340.3

[58] Field of Search ..... 15/346, 340.3

[56] References Cited

U.S. PATENT DOCUMENTS

| | | | |
|---|---|---|---|
| 3,007,191 | 11/1961 | Braun | 15/346 |
| 3,755,851 | 9/1973 | Williams | 15/346 |
| 4,110,864 | 9/1978 | Gunnarsson | 15/346 |
| 4,620,341 | 11/1986 | Rigby | 15/339 |
| 4,773,121 | 9/1988 | Young | 15/346 |
| 4,951,347 | 8/1990 | Star et al. | 15/346 X |
| 5,542,148 | 8/1996 | Young | 15/346 |

OTHER PUBLICATIONS

Schwarze Industries Catalog, 1986, p. 5 entitled "Broom Assist".

*Primary Examiner*—Chris K. Moore

*Attorney, Agent, or Firm*—Wallace G. Walter

[57] ABSTRACT

A pavement sweeping apparatus includes an angled, counter-rotating transverse roller broom followed by a high pressure/high velocity and full-width blast of air to remove particles too small for the broom to sweep up. The roller shaped broom has auger wound bristles causing dynamic propulsion of objects that come in contact with the surface of the rotating broom. The objects are forced by mechanical action, both by the windrow effect of the transverse angle of the broom and, additionally, by the augering action of the helical wound broom bristles to propel object toward an exhaust port of the powerhood for further transfer into a storage bin. A blast orifice, narrow and elongated in shape with its elongated length angled in a transverse position and parallel with and positioned behind the broom, entrains fine particles and small objects not propelled and windrowed by the broom will be blasted by the high-velocity air and forced back under the broom where they are forced back in front of the broom again to be transferred toward the exhaust port. Some of the extremely small particles or objects will be propelled entirely by the high velocity air stream as the broom will have limited effect on extremely fine particles of a size not visible by the human eye.

22 Claims, 9 Drawing Sheets

SURFACE CLEANING APPARATUS

CROSS REFERENCE TO RELATED APPLICATIONS

The subject matter of the present application is disclosed in applicant's co-pending Provisional U.S. patent application Ser. No. 60/007754, filed Nov. 30, 1995 from which priority is claimed.

BACKGROUND OF THE INVENTION

The present invention relates to a surface cleaning apparatus, and, more particularly, to sweeping hoods, i.e., pickup heads for vehicle-mounted street sweepers and particularly for surface cleaning sweepers, especially sweepers using an air recirculation system to generate air pressure and suction. Heretofore, sweeping heads having both air pressure blast and suction or suction hoods having only suction have been found inadequate when sweeping debris from a paved or other surface. Debris often adheres or otherwise sticks to the surface of pavement because of being repeatedly forced into the surface by vehicles using the roadway. The problem of adherent debris has been addressed by using a vehicle-mounted rotating broom to mechanically dislodge debris followed by a separate air/suction or vacuum sweeper. As can be appreciated, the use of two different types of sweeping machines increases the costs associated with debris removal. In an attempt to eliminate the necessity of utilizing both mechanical broom sweepers immediately followed by air/suction or vacuums weepers, several broom-in-the-head sweepers were developed and used. One fault with the previous broom-in-the-head designs is that the mechanical broom is placed behind the blast orifice. In air/vacuum type sweepers, the high pressure air blast does not allow even a high rotational-speed broom to throw much of the debris through the curtain of high pressure air, and, as this occurs, the mechanical broom positioned at the rear becomes overwhelmed by a buildup of debris; the broom tends to climb over the debris which is then lost behind the sweeper. Additionally, in the earlier broom-in-the-head sweepers, the mechanical broom located behind the blast orifice was positioned straight across in a transverse attitude, thus, the ability to position the mechanical broom at a slight angle to create a windrow effect upon the debris was not readily possible. As this situation occurs, usually after a rain, after snow melts, around construction sites, behind road spills from vehicular haulers, and other instances, and especially during spring cleanup (which involves several months every year), mechanical broom sweepers followed by air/vacuum sweepers are utilized traveling in tandem. This combination of a leading mechanical broom and a trailing air/suction sweeper, of course, adds to cost of pavement sweeping cleaning.

SUMMARY OF THE INVENTION

In view of the above, it is an object of the present invention, among others, to provide an improved surface cleaning powerhood suitable for cleaning paved surfaces.

In view of the above, it is an object of the present invention, among others, to provide a high-efficiency surface cleaning powerhood suitable for cleaning paved surfaces that includes the benefits of both a broom sweeper and an air/suction sweeper.

In view of the above, it is an object of the present invention, among others, to provide an improved surface cleaning powerhood having a broom that can be changed by the operator in a minimum amount of time without the use of hand-tools.

The present invention provides a combined broom/air pickup assembly for cleaning debris from pavement and road surfaces. A powerhood assembly defines a plenum-like chamber that carries a rotatable broom that leads a trailing air-blast orifice. Pressurized air is introduced into one end of the plenum through a slot-like blast orifice that is at least coextensive with the broom. The broom is rotated so that debris on the pavement encountered by the broom is projected in the direction of travel into the flow of pressurized air. The entrained debris is then carried by the air stream to a suction outlet for further processing in which the debris is removed. The pressurized-air is then recirculated through the powerhood.

The rotatable broom preferably is of the helically wound type so that the broom will encourage physical migration of debris toward and to the suction outlet of the powerhood. In addition, the principal axis of the broom is aligned at a small angle (i.e., 3–8 degrees) relative to an axis transverse to the longitudinal axis of the vehicle. This non-transverse alignment further encourages debris to migrate toward and to the suction outlet of the powerhood.

The blast orifice is positioned in a trailing relationship to the broom along a generally spaced parallel axis. In the preferred embodiment, the cross-section of the blast orifice is adjustable by an operator for various sweeping conditions.

The broom is mounted for rotation about its axis by quick-release devices so that the broom can be quickly removed and replaced by an operator without the need for tools.

Placement of the mechanical broom forwardly of the blast orifice allows a design where the mechanical broom is placed at an angle to maintain a windrow effect with the contained movement of debris and air mass. The blast orifice aligned at a angle similar to that of the broom further enhances the windrow effect. The helix or auger-type winding of the broom with fibers positioned apart, with a space between consecutive wraps of the broom also creates a mechanical auguring effect to further enhance the rapid transfer of debris toward on end of the powerhood where the debris is vacuumed up and loaded into the sweeper's debris bin or hopper. This combination of mechanically scrubbing and pneumatically blasting allows extremely high speed and aggressive sweeping of materials that heretofore were unable to be swept except with a combination of several machines operating in tandem and requiring more than one operator.

In actual tests it has been found that by placing an open helix-wound, angled windrow broom ahead of an angled windrow blast of pressurized air increased a given sweeper's efficiency and performance by 300 or more percent. Materials that were routinely swept up at one or two miles per hour can easily be swept up at six or more miles per hour.

Other objects and further scope of applicability of the present invention will become apparent from the detailed description to follow, taken in conjunction with the accompanying drawings, in which like parts are designated by like reference characters.

DESCRIPTION OF THE PREFERRED EMBODIMENT

Figure 1:
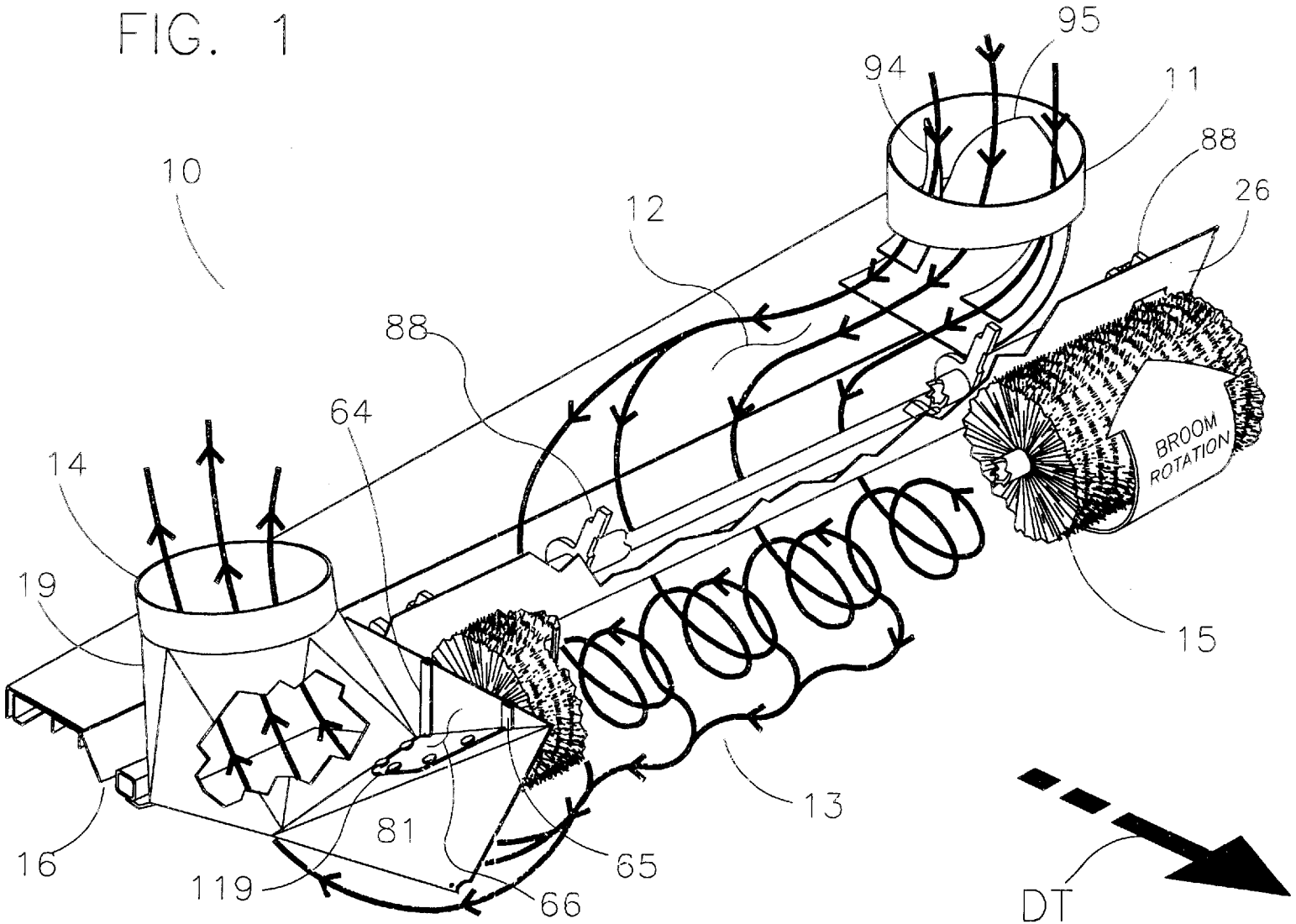
FIG. 1 is a schematic and a multi-windowed view of a powerhood including an auguring, windrow broom and air stream flow arrows schematically illustrating airflow through the device.

A powerhood in accordance with the present invention is shown in FIG. 1 and designated generally therein by the reference character 10. In the preferred applications, the powerhood 10 illustrated is designed to assemble to the underside of various types of commercial trucks including vehicles such as the Ford CF-7000, Ford LN-7000, Ford F-700D, Navistar N-4700, Isuzu/GM W-7, GMC TIPKICK and similar vehicles. As shown in FIG. 1, the powerhood 10 includes a pressurized-flow inlet tube 11, a pressure chamber 12, a full-width blast orifice 16, a mechanical rotating broom 15, a suction chamber 17, and a suction tube outlet 14.

Figure 3:
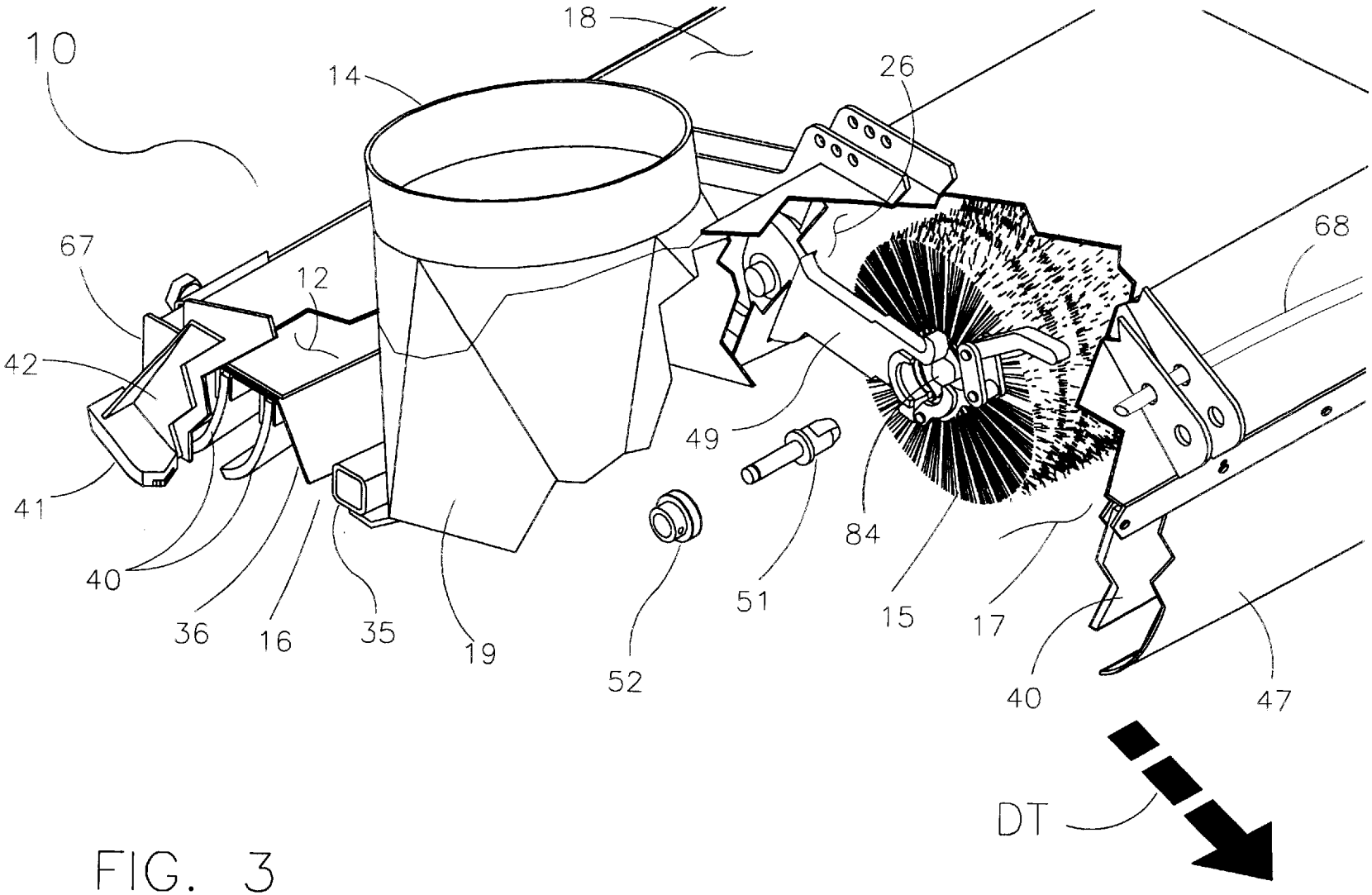
FIG. 3 is a windowed view revealing the end of the mechanical broom nearest the suction tube of the powerhood and shows a quick-release clamp for the broom bearing.
Figure 6:
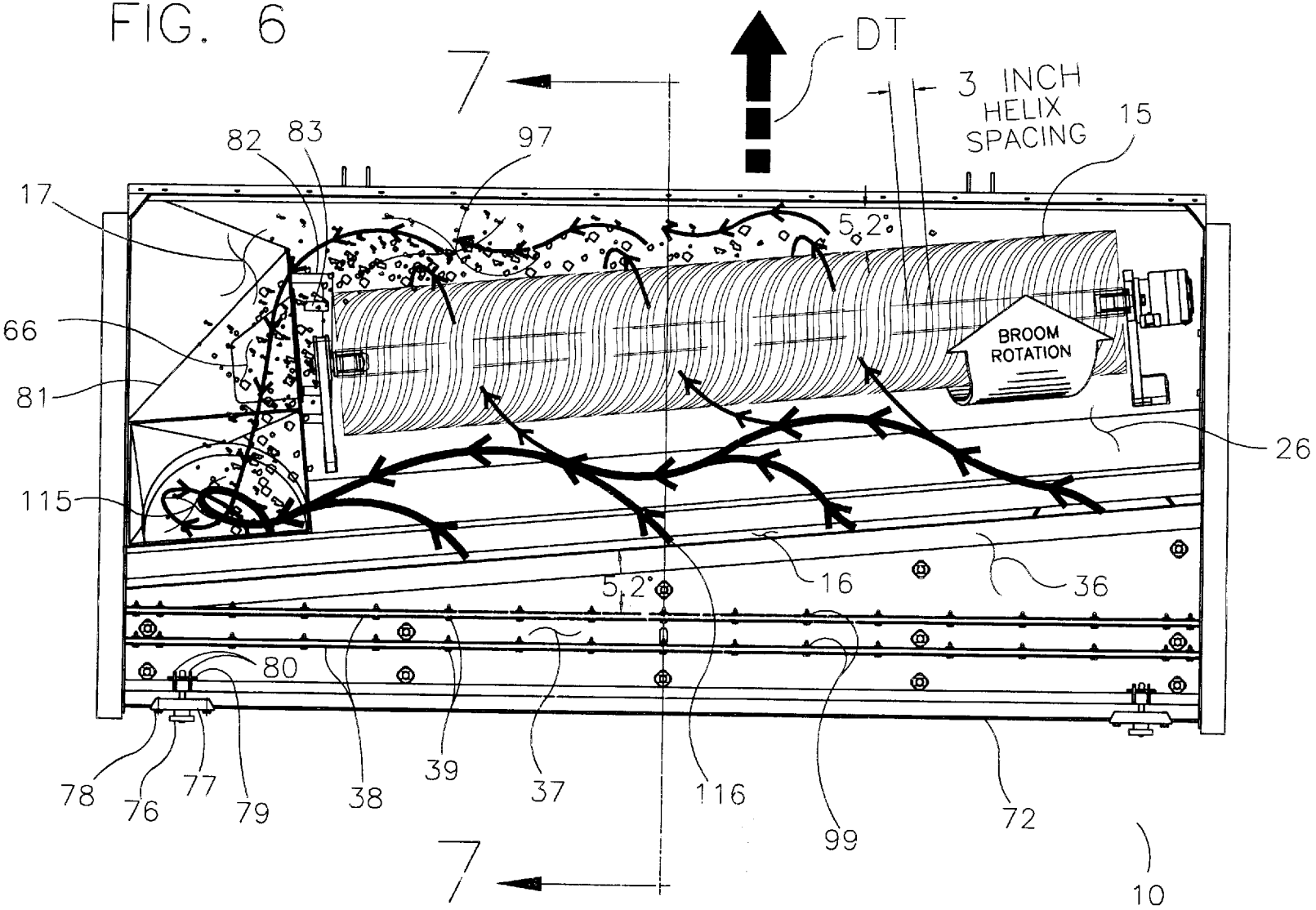
FIG. 6 is a bottom view of the powerhood illustrating the angular position of the broom and the angular position of the blast orifice.

The broom 15 is positioned ahead or forward of the blast orifice 16 in relationship to the travel direction DT and is of the helically wound type with an approximately three-inch pitch separating respective flights. As explained below, the broom 15 is mounted at an angle relative the travel direction DT and, in combination with the helix pattern, the broom 15 functions to cause swept debris to migrate toward and to the suction outlet 14 of the powerhood 10. As shown in FIG. 3 and in FIG. 4, the broom 15 (FIG. 3) is rotatably supported by a broom idler bearing 52 that journals an idler hub 51 carried in a broom core 84 for rotation about the broom axis. The broom 15 is supported on the opposite end (FIG. 4) by a drive hub 22 that is inserted into and received by the broom core 84. In the preferred embodiment, the drive hub 22 has a square cross-section that is slidably received into a similarly configured opening in the broom core 84, the two parts configured for a torque-transmitting, mating relationship. A hydraulic motor 21 provides rotational power to the broom 15. The motor 21 includes a drive shaft (unnumbered) supported for rotation by an internal load-supporting bearing so that the broom 15 rotates about the axial centerline of the motor bearing. The motor 21 is secured to a motor support arm with attachment hardware (not shown), and the drive hub is secured onto the motor shaft by set screws and a key to eliminate relative rotational slippage therebetween when power is applied to the motor 21. As shown in FIGS. 1 and 6, the broom drive motor 21 rotates the broom 21 so that debris is moved in the travel direction DT.

The drive motor 21 is mounted at one end of a pivotable (FIG. 8) yoke weldment assembly 90 and the broom idler bearing 52 is mounted at the other end in the idler arm 49. The yoke weldment assembly 90 includes the motor support arm 24 that carries the broom motor 21, a cleat 34, a hydraulic hose tunnel 25, ribs 88, a hollow shaft 50, and the clamp arm 49 which carries the broom idler bearing 52. The ribs 88 include a hole (unnumbered) of sufficient diameter to allow the shaft 50 to rotate freely relative thereto. The partition 26 (FIG. 4) includes two slots (unnumbered) that allow the motor support arm 24 and the clamp arm 49 to protrude through the partition 26 to allow the arms to be rotated through a range of motion or arc 20 (see FIG. 7) inside of the suction chamber 17 in which the broom 15 is located. The position of the broom 15 at the opposite ends of its range of motion represents an upper, inoperative position and a lower, operative position in which the broom 15 is in contact with the pavement. Additionally, a quick-release clamp assembly 89 includes of a clamp handle 55, links 87, an idler bearing clamp 53, a clevis pin 54, cotter pins 85, and hinge bolt 86 connect to the idler arm 49. The hinge bolt 86 is received in a drilled hole (unnumbered) in the idler arm 49 and held in place by a locknut 120. The clamp handle 55 can enter and be received in a rearwardly facing hook-like recess (unnumbered) in the top front of the idler arm 49 to hold the clamp assembly 89 in its closed position. The links 87 and handle 55 are configured to define an over-center toggle that releaseably holds the idler bearing 52 in place. As explained below, the quick-release clamp assembly allows an operator to quickly remove and replace the broom 15 without tools.

Figure 2:
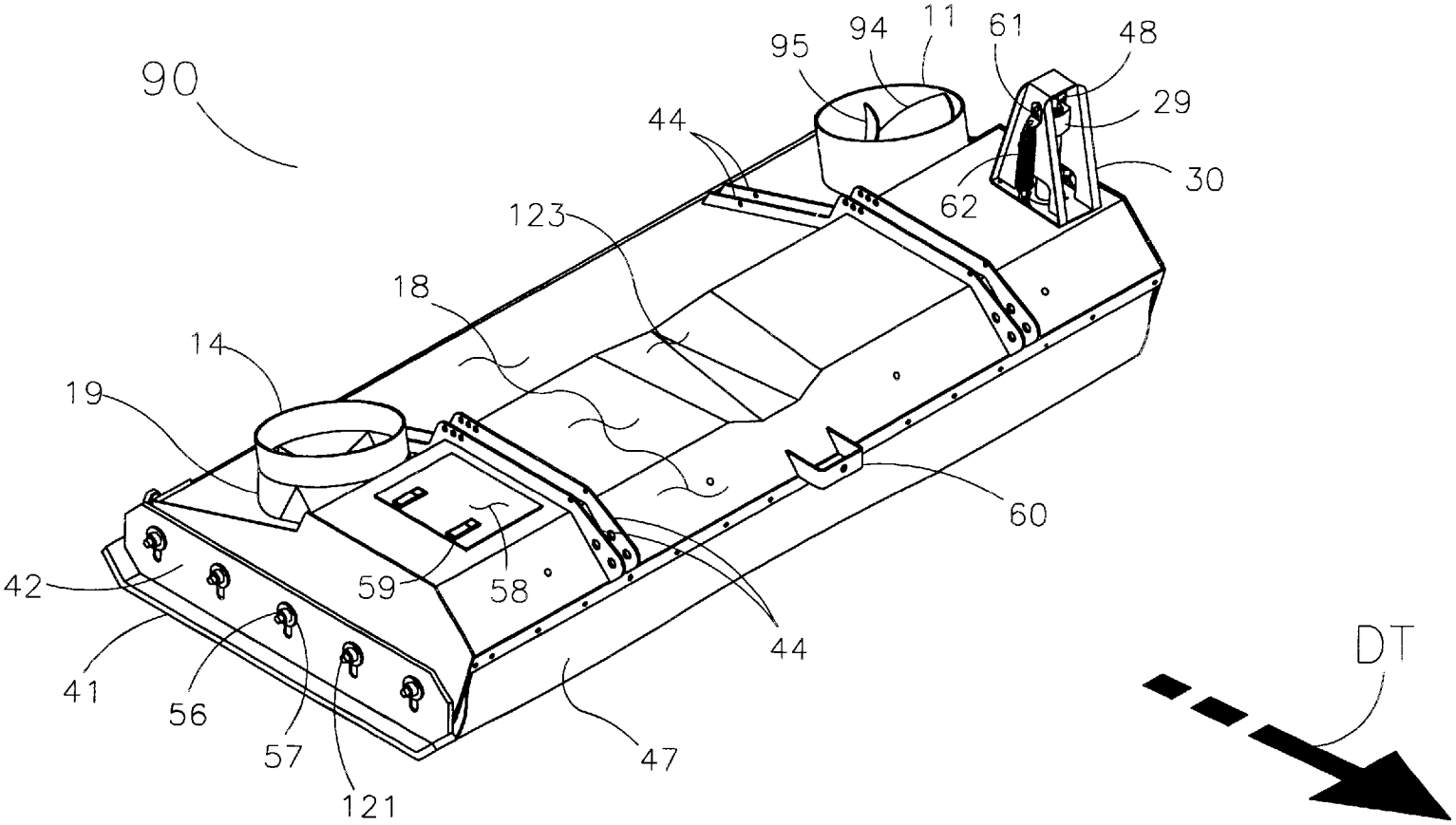
FIG. 2 is a view showing the front right-hand corner of the powerhood in its assembled form.
Figure 4:
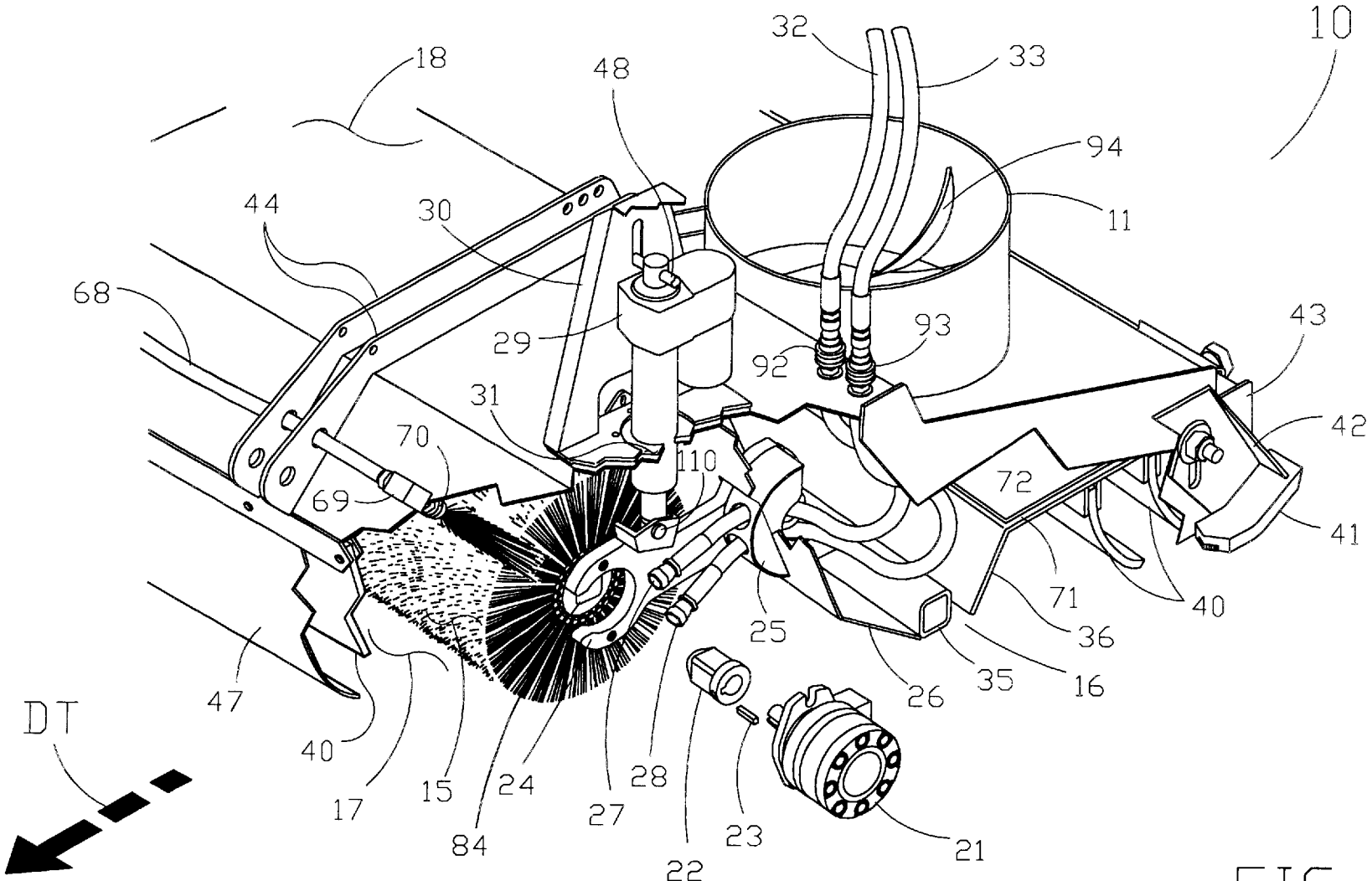
FIG. 4 is a windowed view of the powerhood mechanical broom hydraulic drive motor, broom height positioning device, and the position of broom pivoting components.
Figure 9:
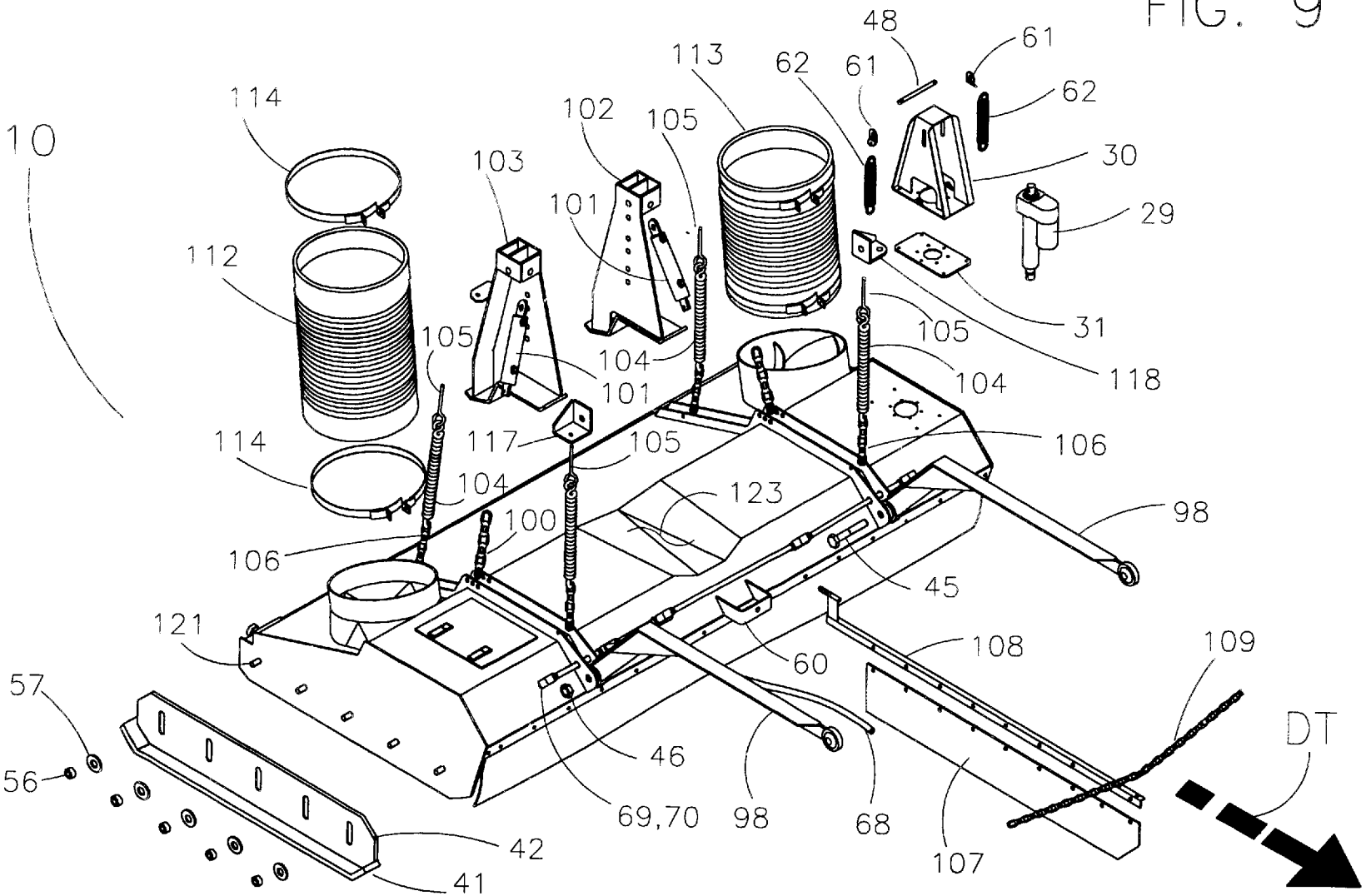
FIG. 9 is an exploded perspective view of the major parts of the powerhood.

As shown in FIGS. 2, 4, and 9, a bidirectional up/down actuator 29 is supported by a tower-type mount 30. A retainer pin 48 is pulled down by tension springs 62 (FIG. 9) and retainer clips 61 (FIG. 2). The housing portion of actuator 29 enters the suction chamber 17 through an elastomer sealing membrane 31 having a circular hole therein to accommodate the actuator 29. The lower, ram end of the actuator 29 is connected to a clip 34 and the motor support arm 24 by a pin 110. Operation of the actuator 29 in one direction or the other lifts or lowers the broom 21 through a range of motion or arc 20 shown in schematic form in FIG. 7.

The supply 27 and return 28 hoses direct high-pressure hydraulic fluid to and from the broom drive motor 21. The hoses 27 and 28 are routed through a tunnel 25 welded onto the motor support arm 24 and are connected to quick-disconnect couplings 92 and 93, respectively. The pressure hose 32 and the return hose 33 are also connected to the same quick-disconnect couplings 92 and 93, respectively.

Figure 7:
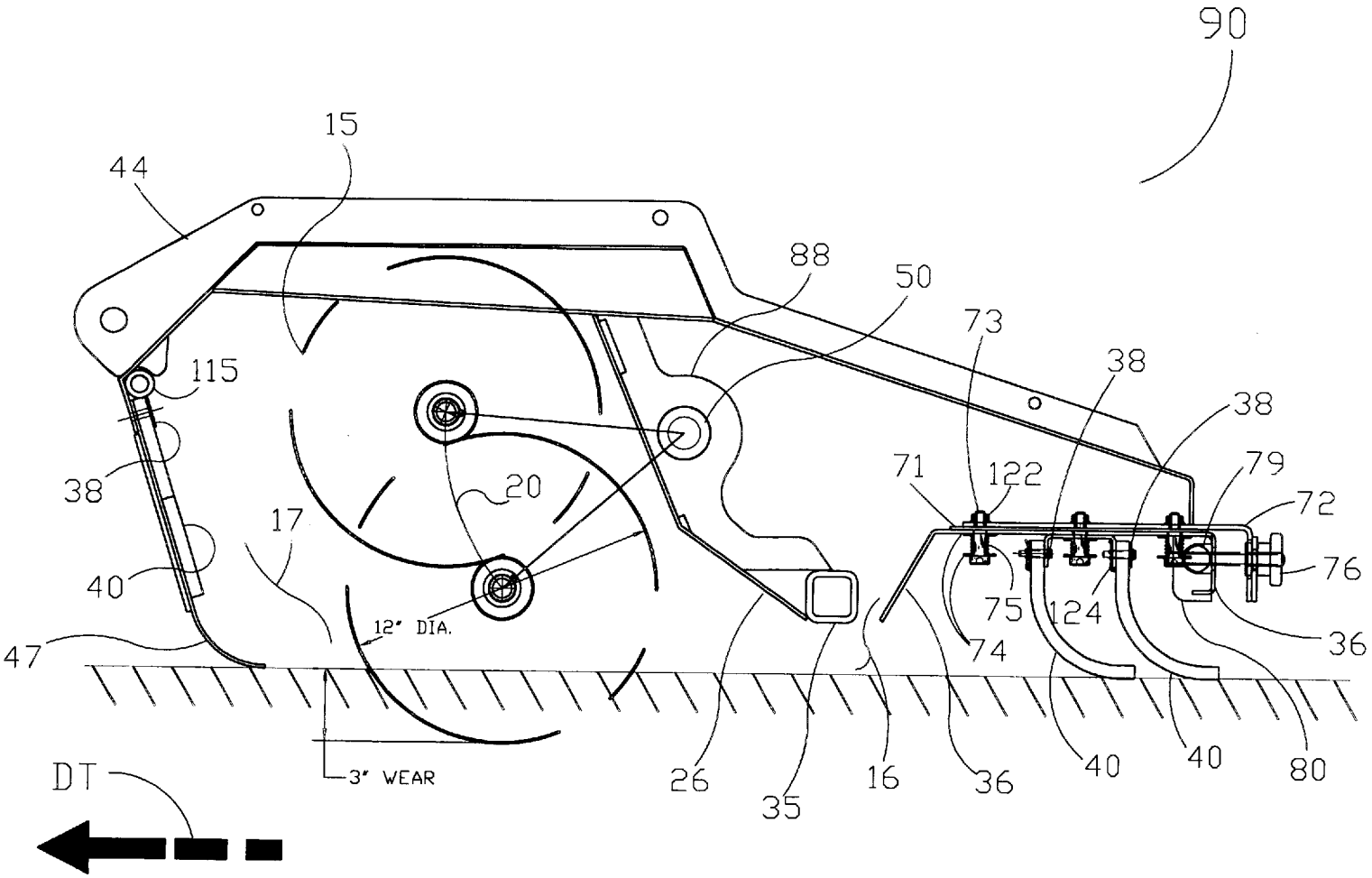
FIG. 7 is a partial schematic illustration of the broom in one of two positions (dotted-line illustration) taken along lines 7—7 of FIG. 6.

A reinforcement tube 35 forms the forward-most or leading edge portion of the blast orifice 16, and the bottom edge of partition 26 is welded or otherwise secured to reinforcement tube 35. The uppermost edge of the partition 26 is welded or otherwise secured to the top plate 18 of the powerhood 10. As shown in FIG. 7, the rearward edge of the blast orifice 16 is defined by an orifice plate 36. As explained in more detail below, the front-to-rear dimension of the blast orifice 16 is user-adjustable to accommodate different pavement/debris conditions.

As shown in FIG. 2 and FIG. 9, the pressurized-air inlet tube 11 is welded or secured onto the top plate 18 directly over an inlet hole of the same diameter as the inside diameter of the inlet tube 11. Air-turning vanes 94 and 95 are positioned inside of pressurized-air inlet tube 11 to insure efficient flow of the pressurized inlet air into the pressure chamber 12.

Figure 5:
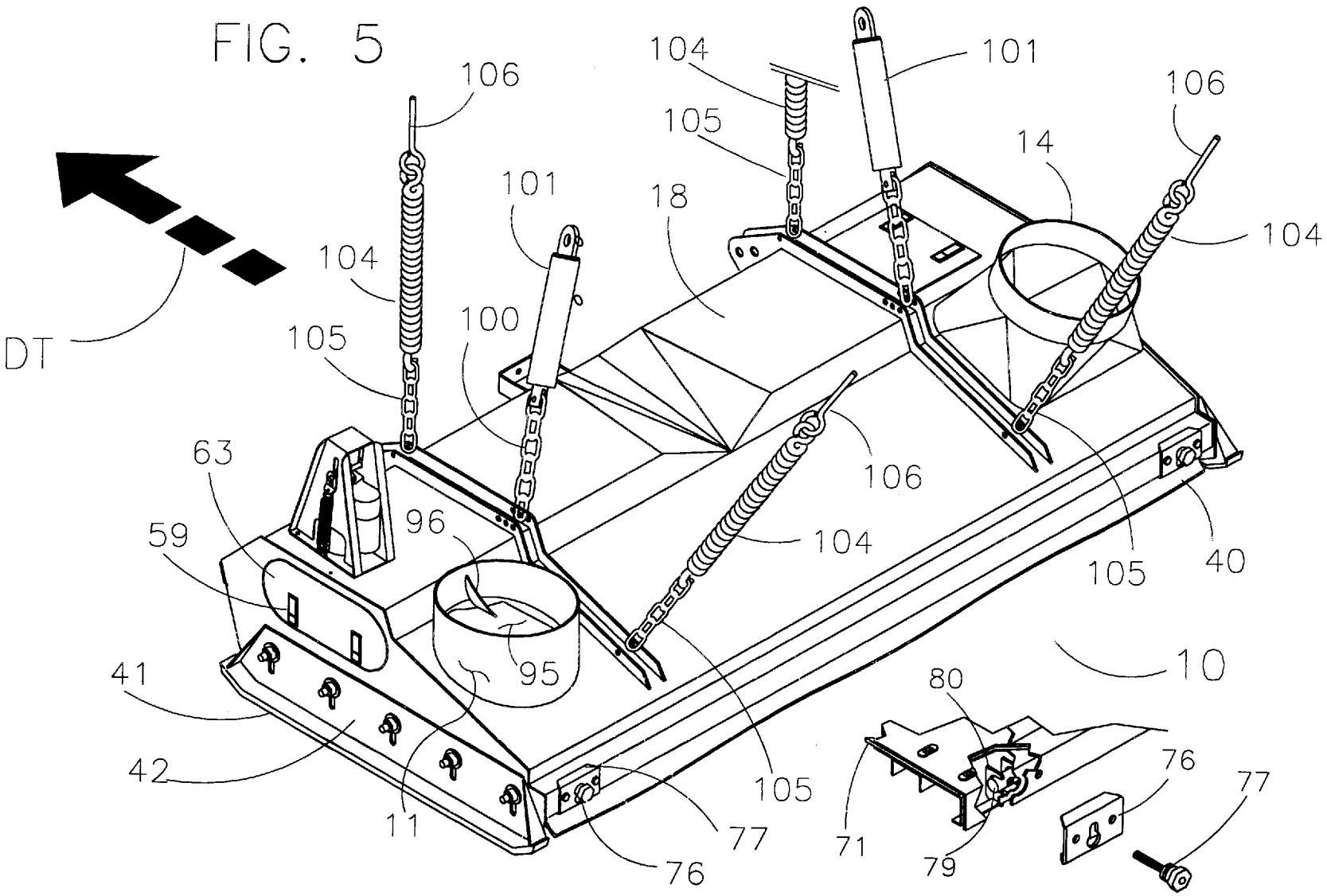
FIG. 5 is a view of the left rear corner of the powerhood and illustrates hydraulic cylinders for lifting the powerhood, upstops, and adjustable lifting springs.

Trunnions 44 (FIGS. 4, 5, and 7) are welded to the plate 18 for lifting and pulling the powerhood 10 and to maintain structural integrity of the powerhood 10 configuration in all applications. Spring counterbalance chains 105, lift chains 100, and drag links 107 bolt onto trunnions 44 (FIG. 5). As shown in FIG. 4, water-spray nozzles 70 mount through holes in the top plate 18. The water-spray nozzles 70 are equally spaced along the side-to-side dimension of the broom 15 and are mounted above and slightly forward of the broom 15. The water nozzles 70 are directed approximately toward and along the full length of the broom core 84. A water-supply hose 68 and elbows 69 connect nozzles 70 to a vehicle water-pressure pump and associated valves (not shown). A water-supply hose 68 is routed through guide holes (unnumbered) in the trunnions 44. As explained below, the nozzles 70 fan-spray the water onto the broom 15 and functions to suppress air-borne dust during sweeping.

FIG. 6 is a view of the bottom of powerhood 10 showing the angular position of the broom 15 and the angular position of the blast orifice 16. As shown, the broom 15 and the blast orifice 16 are positioned at an angle of slightly over 5 degrees (5.2 degrees in the case of the preferred embodiment) relative to an axis transverse to the travel direction DT where the leading end of the broom 15 nearest the pressurized-air inlet tube 11 is forward of trailing edge of the broom 15 nearest suction outlet tube 14.

As shown in FIG. 7, the pressure chamber 12 is of a relatively large cross-section at the entrance of the pressurized air through the pressurized-air inlet tube 11, and the cross section is made progressively smaller toward its opposite end nearest the suction tube 14. The pressure chamber 12 is the volume defined within the boundaries identified by the top plate 18, the left-hand endplate 43, the right-hand endplate 67, the partition 26, the reinforcement tube 35, the blast orifice shelf 72, and the blast orifice plate 36. The blast orifice 16 extends substantially along the side-to-side dimension of the powerhood 20 and is the outlet for the pressurized air escaping from pressure chamber 12. The suction chamber 17 is the volume defined by the top plate 18, the partition 26, end plates 43 and 67, and front elastomer curtains 40 and 47. The suction chamber 17 is of a smaller cross-section nearest and forward of the same end of the powerhood 10 where the pressure tube 11 is located and is made larger nearest the suction tube 14 and the suction transition 19. The broom 15 is positioned the same distance from the partition 26 throughout its total length. The broom 15 is raised and lowered by actuator 29 through a range of motion represented by arc 20 shown in FIG. 7 and pivots about the transverse center of the axle tube 50.

Pressurized air 116 escaping from the slanting, forwardly directed blast orifice 16 is restricted from exiting to the rear of the powerhood 10 by two substantially parallel curtains 40 secured by fasteners 38 to a support bracket 124 (best seen in FIG. 7). Because of the curtains 40, the only remaining flow path for the pressurized air is in the forward direction toward the broom 15 at and along a line where the broom 15 contacts the ground or paved surface being cleaned.

The front-to-rear pneumatic "width" of the blast orifice 16 is adjustable by the operator in order to selectively increase or decrease the width of the orifice and thereby adjust the air blast. The blast orifice 16 is defined between the rolled-steel tube 35 and the leading edge and the longitudinally adjustable orifice plate 36. The tube 35 has a rounded corner forward of and opposite the lower edge of the orifice plate 36; the rounded corner defines the forward air-flow defining surface or edge of the blast orifice 16. The blast orifice shelf 72 is a plate secured to the powerhood 10 and forms the flat mounting surface upon which the blast orifice slide assembly 111, consisting of the blast orifice plate 36, the rear curtain hanger 37, the two rear curtains 40, two curtain clamp strips 38, cylinder nut retaining ears 80, and attachment hardware, is attached. A nonmetallic bearing surface material in the from of a shim 71 is fitted between the stationary shelf 72 and the blast orifice slide assembly 111. Slots (not shown) aligned generally in the travel direction DT in blast orifice plate 36 allow forward and rearward movement of the blast orifice assembly by user-adjustable screws 76 located near opposite transverse ends of the blast orifice plate 36. Sufficient but not excessive clamping pressure of the plate 72, the bearing plate 71, and blast orifice slide plate is by compression springs 75 having flat washers 74 at either end of the springs and by cap screws 73 of sufficient length to assure their retention. The compressed length of the springs 75 allow the blast orifice plate 36 to be moved forward and rearward by turning the hand-adjustable screws 76 so that the blast orifice opening 16 can be varied. By adjusting the blast orifice 16 opening from either or both transverse ends of the powerhood 10, the blast orifice 16 opening from either or both transverse ends of the powerhood 10 the blast orifice 16 opening can be tapered to allow more pressured air to escape near the desired end of the powerhood 10 to create the optimum performance of the powerhood 10 depending upon requirements and conditions of the particular sweeping task.

As best shown on the left side of FIGS. 2 and 9, the powerhood 10 is provided with pavement-engaging skids 41 on opposite sides thereof. Each skid 41 is part of a larger skid weldment that includes a skid plate 42 and the shoe or runner 41. Each skid runner is high density, sintered long-life composite material chemically bonded and permanently fused into the skid shoe 41. The skid shoes 41 support the weight of the powerhood 10 and define the air pressure and suction or vacuum seal at either transverse end of the powerhood 10.

Figure 8:
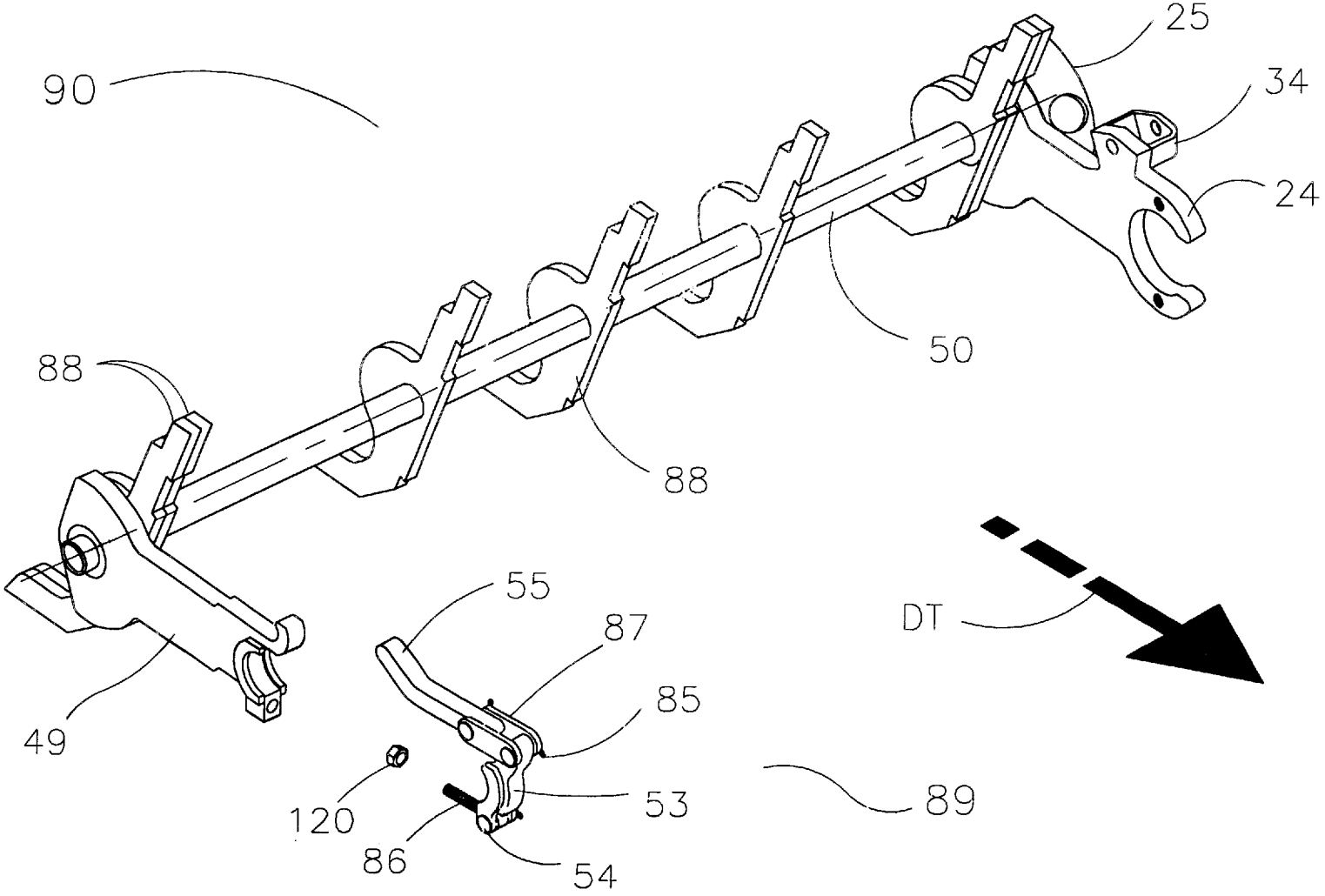
FIG. 8 illustrates a yoke weldment assembly for mounting the hydraulic motor for driving the broom.

As shown in FIGS. 7 and 8, the yoke weldment assembly 90, the motor support arm 24, and the idler arm 49 are welded at opposite ends of the hollow steel pivot axle 50.

The ribs 88 are placed onto the axle 50 prior to welding the arms 24 and 49 at the opposite ends of the axle 50.

The openings formed in the ribs and through which the axle 50 extends have sufficient clearance relative the outside diameter of the axle 50 to allow the axle 50 to rotate relative the ribs 88 so that the axle 50 can rotate freely through range of motion of arc 20. The motor support arm 24 and the idler arm 49 are positioned so that their ends opposite the hollow axle 50 protrude through the partition 26 and minimal clearance between the arms and rectangular holes in the partition 26 is realized. The arms 24 and 49 are configured so as to cause constant and minimal clearance regardless of the angular position of the arms 24 and 49.

The hose tunnel 52 allows the pressurized hydraulic fluid hose 28 and the return hose 27 for the broom drive motor 21 to be routed through the partition 26 without causing undesired rubbing motion with the partition 26. The yoke 90 weldment assembly is secured onto the partition 26, as illustrated in FIG. 7, by attachment of ribs 88 onto the partition 26.

FIGS. 1–3 and 6 identify voided air chamber 13 located beneath the access door 58. The bottom surface of the chamber 13 is created to cause airflow into the suction transition 19 and through the suction tube 14 to accelerate and subsequently produce an increase in the air velocity causing an increase in the venturi action to enhance suction (negative air pressure) at the critical junction of a mass of medium to high cross-sectional density materials (debris) 97 accelerated in a transverse direction to quickly change direction and begin an upward path away from the paved surface.

As shown in FIG. 2, a top access port includes door plate 58, fingers 83, and spring-loaded trip latches 59 that are utilized to access chamber 13 without the need of tools. After the access door 58 is removed, entrance into suction chamber 17 is possible (also without the need of tools) by removal of thumb nuts 119 and interior access door 66 (FIG. 1). The idler-bearing access-door 66 is secured in place by thumb nuts 119 by vertical guides 64 and 65 welded into the suction panel 81 vertical wall opening. After the door 66 is removed, the clamp assembly 89 (FIGS. 3 and 8) is accessible to the operator. The clamp handle 55 can then be swung upwards to release broom idler bearing 52. The handle 55, links 87, and bearing clamp 53 can then be hinged away from the broom idler bearing 52. Once released, the broom idler bearing 52, idler hub 51, and the broom 15 can be pulled out from under the powerhood 10. The broom idler bearing 52 and idler hub 51 can be removed from the broom core 84, and a new broom 15 can be inserted in reverse sequence of afore described operations. The broom 15 is designed so that it cannot be inserted backwards as either end is the same helix as viewed from respective ends.

Access to the broom drive motor 21 is provided by an access port on the drive motor side of the powerhood 10. The drive motor access port is defined by an access door 63. The access door 63, FIG. 5, is constructed of door plate 63, fingers 83, and spring-loaded trip latches 59. The access door 63 is utilized as access to the broom drive motor 21 and drive motor end of the broom 15. When replacing the broom 15, the operator or mechanic can reach through the access port and guide the broom core 84 onto drive hub 22.

FIG. 9 is an illustration of the powerhood 10 showing some of the additional items need to facilitate desired and necessary containment, utilization, adjustment and control of the apparatus. Specifically, upstops 102 and 103 are bolted onto the sides of the truck frame (not shown) and provide the vertical positioning of the powerhood 10 then it is raised by retraction of hydraulic cylinders 101. Lift chains 100 attach the lift cylinders 101 to the trunnions 44. The cylinders 101 are powered by pressurized hydraulic fluid from the hydraulic pump (not shown) and the hydraulic cylinders are controlled by controls typically located inside of the truck cab. The hydraulic cylinders provide lifting power to lift the powerhood 10 from the paved surface and forceably hold the powerhood 10 tight against upstops 102 and 103 for traveling at highway speeds. Counterbalance springs 104 are attached to the trunnions 44 by spring chains 106 and are connected by an adjustable rod eye 105 to permanent member 103 and 102 or spring anchor 117 or 118. The adjustable rod eyes allow the tension of the counterbalance springs to be varied to allow resultant contact pressure to paved surface to be adjusted to approximately forty to sixty pounds. The pressure tube 113 and the suction tube 112 are airtight and connected to the powerhood 10 pressure and suction tubes and the sweeper's fan discharge and the hopper's suction inlet transition, respectively, by band clamps 114. Hoses 113 and 112 are constructed of long life anti-wear rubber, fabric, and reinforced with spiral spring wire. The left side and right side skids defined by the skid shoe 41 and the skid plate 42 are the same size and of identical configuration and can be interchanged left and right in the event the wear pattern is not uniform allowing extended life of the skids. Skid retaining stud bolts 121 provide an attachment anchor for the skids 41 and 42 and are fitted with nuts 58 and clamp discs 57. Vertical slots in the skid plates 42 allow adjustment of the left and right skids to form a level bottom surface for the powerhood 10.

Drag links 98 are connected a stationary member permanently affixed onto the truck frame and the opposite end is connected to the front of the powerhood 10 between pairs of trunnions 44 with bolts 45 and nuts 46. At either end of the drag links 98 are swivel joints allowing free rotation and swiveling of the drag links 98. A deflector curtain 107 is supported beneath the center of the truck vehicle just forward of the powerhood 10 and the rear end of the curtain assembly is attached onto the front of the powerhood 10 by a bolted end retained through curtain hanger 37. The front end of the deflector curtain assembly is supported by a length of welded link chain 109 welded onto the front end of curtain hanger 108 and opposite ends of the chain 109 are bolted to the truck vehicle frame.

As shown in FIG. 2, a trough 123 permanently affixed to a top plate 18 creates a recess with the longitudinal axis of the recess positioned in a forward-to-rearward alignment. The trough 123 provides clearance of top plate 18 and the truck's drive shaft when the powerhood 10 is lifted up against the upstops 102 and 103.

As can be best appreciated from FIGS. 6 and 7, during normal operation, the actuator 29 is operated to lower the broom 15 onto the pavement while the hydraulic boom motor 21 rotates the broom 15 (clockwise as viewed in FIG. 7). Concurrently, pressurized-air provided by a blower (not shown) mounted in the host truck is forced through the blast orifice 16 toward the pavement at a selected angle of attack relative the travel direction DT. As the powerhood 10 advances along the travel direction DT, the individual bristles (unnumbered) of the broom 15 contact any debris on the pavement and impart kinetic energy to the debris particles to cause the particles to leave the pavement. The particles are entrained in the air flow and, as shown by the various air stream arrows in FIG. 6, are moved toward and to the suction outlet opening. For those particles that are dislodged from the pavement by the broom 15 but do not become entrained in the air stream, these particles are continuously and repeated "kicked" into the chamber 17 while the broom 15 augers these particles toward and to the suction outlet where the probability of aspiration increases. Those particles that have an adherent quality or which lodge in the bristles of the broom 15 will remain in place until dislodged. If the adherent particles are dislodged from the trailing side of the broom 15, the air blast from the orifice 16 will either entrain those particles in the air stream or represent the particles to the broom 15. Since both the broom 15 and the blast orifice 16 are aligned at an angle of about 85 degrees relative to the travel direction DT, all dislodged debris is windrowed toward and to the suction outlet.

The powerhood 10 has demonstrated a 3-fold increase in debris removal compared to prior designs. Thus, a pavement sweeping truck equipped with a powerhood 10 in accordance with the present invention can sweep at a speed of, e.g., six miles per hour with the same sweeping efficiency of a prior art design sweeping at a speed of two miles per hours. One of the criteria by which casual observers evaluate pavement sweepers is by the debris left behind the vehicle. Placement of the blast orifice 16 behind the broom 15 allows any debris that is not captured by the broom 15 to be quickly reintroduced into the broom 15 to minimize the quantity of debris that escapes removal. The quick-release components described above allow the broom 15 to be quickly removed and replaced by an operator with the need for the usual hand-tools; this feature minimizes downtime and labor costs associated with the replacement of the broom 15.

The present invention advantageously provides a surface cleaning apparatus in the form of an improved powerhood for mounting on a carrier vehicle in which the combined benefits of a air/suction and broom system are realized.

As will be apparent to those skilled in the art, various changes and modifications may be made to the illustrated surface cleaning apparatus of the present invention without departing from the spirit and scope of the invention as determined in the appended claims and their legal equivalent.

What is claimed is:

1. A surface cleaning apparatus for removing debris from a ground surface while moving relative to the ground surface in a forward travel direction, comprising:

a rotatable broom extending along a principal broom axis for rotation thereabout, said broom having helically wound bristles at a selected pitch;

an air-blast orifice spaced rearwardly from said broom relative to the travel direction and extending at least partially coextensive with said broom;

a housing enclosing said broom and air-blast orifice, said housing having sides thereof for defining an air-plenum when said housing is positioned on a pavement to be cleaned;

an inlet on one side of said housing for introducing pressurized air to the air-blast orifice;

an outlet on another side of said housing for exhausting air from the housing and any debris entrained therein; and means for rotating said broom so that debris on the pavement is propelled forwardly in the direction of travel.

2. The surface cleaning apparatus of claim 1, wherein said broom is aligned at an angle relative to the travel direction.

3. The surface cleaning apparatus of claim 1, wherein said broom is aligned at an angle of about five degrees relative to an axis transverse to the travel direction.

4. The surface cleaning apparatus of claim 1, wherein said helically wound bristles of said broom causes swept debris to migrate toward and to said outlet.

5. The surface cleaning apparatus of claim 4, wherein said pitch is about 3 inches.

6. The surface cleaning apparatus of claim 1, wherein said air-blast orifice is co-aligned with said broom and at least coextensive therewith.

7. The surface cleaning apparatus of claim 1, further comprising:

a swing-arm assembly mounted for pivotal movement through a range of motion and having a first and second arms;

said broom having an axle journalled at opposite ends in said first and second arms of said swing-arm assembly.

8. The surface cleaning apparatus of claim 7, further comprising:

a drive motor mounted in one of said first or second arms of said swing-arm assembly and connected in driving engagement with said broom to selectively cause rotation thereof;

an idler bearing mounted in the other of said first and second arms of said swing-arm assembly and rotatably supporting the other end of said broom axle.

9. The surface cleaning apparatus of claims 8, further comprising:

a drive hub coupling said drive motor and said axle end together for rotation, the drive hub in an axially slidable engagement with said axle end.

10. The surface cleaning apparatus of claim 8, further comprising:

an over-center releasable toggle clamp selectively securing the idler bearing in its swing-arm.

11. The surface cleaning apparatus of claim 7, further comprising:

an actuator connected to said swing-arm assembly for selectively moving the swing-arm assembly through a selected range of motion about the pivot axis of said swing-arm assembly.

12. The surface cleaning apparatus of claim 1, wherein said air-blast orifice directs the pressurized air in a forward direction relative to the direction of travel.

13. The surface cleaning apparatus of claim 12, wherein said air-blast orifice is defined by first and second edges.

14. The surface cleaning apparatus of claim 13, wherein at least one of said edges is user-adjustable to move said at least one edge toward or away from the other of said edges.

15. A surface cleaning apparatus for removing debris from a ground surface while moving relative to the ground surface in a forward travel direction, comprising:

a rotatable broom extending along a principal broom axis for rotation thereabout;

means for rotating said broom so that debris on the pavement is propelled forwardly in the direction of travel;

an air-blast orifice spaced rearwardly from said broom relative to the travel direction and extending at least partially coextensive with said broom, the orifice directing the pressurized air flow in the direction of travel;

a housing enclosing said broom and air-blast orifice, said housing having sides thereof for defining an air-plenum when said housing is positioned on a pavement to be cleaned;

an inlet on one side of said housing for introducing pressurized air to the air-blast orifice; and an outlet on another side of said housing for exhausting air from the housing and any debris entrained therein.

16. The surface cleaning apparatus of claim 15, wherein said broom is aligned at an angle relative to the travel direction.

17. The surface cleaning apparatus of claim 15, wherein said broom is aligned at an angle of about five degrees relative to an axis transverse to the travel direction.

18. The surface cleaning apparatus of claim 15, wherein said broom has helically wound bristles at a selected pitch to cause swept debris to migrate toward said outlet.

19. The surface cleaning apparatus of claim 18, wherein said pitch is about 3 inches.

20. The surface cleaning apparatus of claim 15, wherein said air-blast orifice is co-aligned with said broom and at least coextensive therewith.

21. The surface cleaning apparatus of claim 15, wherein said air-blast orifice is defined by first and second edges.

22. The surface cleaning apparatus of claim 21, wherein at least one of said edges is user-adjustable to move said at least one edge toward or away from the other of said edges.

* * * * *